United States Patent [19]

Schroeder

[11] 4,060,435

[45] Nov. 29, 1977

[54] FLOATABLE INCENDIARY COMPOSITION

[75] Inventor: Fred Schroeder, Lakeview Terrace, Calif.

[73] Assignee: Dow Corning Corporation, Midland, Mich.

[21] Appl. No.: 590,370

[22] Filed: June 25, 1975

Related U.S. Application Data

[63] Continuation-in-part of Ser. No. 487,474, July 11, 1974, abandoned.

[51] Int. Cl.[2] ..... C06B 45/10; C06B 33/00; F42B 11/24

[52] U.S. Cl. ..... 149/19.2; 149/19.3; 149/37; 102/90

[58] Field of Search ..... 149/19.1, 19.2, 19.3, 149/37, 21; 260/824 R, 900, 29.1 SB; 264/127; 102/6, 37.8, 65, 66, 90

[56] References Cited

U.S. PATENT DOCUMENTS

| | | | |
|---|---|---|---|
| 2,949,352 | 8/1960 | Cramer | 149/19.2 |
| 3,137,599 | 6/1964 | Alsgaard | 149/19.2 |
| 3,391,221 | 7/1968 | Gore | 260/824 R |
| 3,456,589 | 7/1969 | Thomison | 149/21 |
| 3,565,706 | 2/1971 | Waite | 149/19.3 |
| 3,665,862 | 5/1972 | Lane | 149/19.2 |
| 3,669,020 | 6/1972 | Waite | 149/19.3 |
| 3,715,246 | 2/1973 | Sayles | 149/19.2 |
| 3,738,878 | 6/1973 | Green | 149/19.2 |
| 3,841,219 | 10/1974 | Schillreff | 102/37.6 |
| 3,951,066 | 4/1976 | Schroeder | 102/6 |
| 3,951,068 | 4/1976 | Schroeder | 102/6 |

*Primary Examiner*—Verlin R. Pendegrass
*Assistant Examiner*—Donald P. Walsh
*Attorney, Agent, or Firm*—Howard W. Hermann

[57] ABSTRACT

There is described a floatable incendiary composition consisting essentially of magnesium powder, an oxidizer and an elastomeric polysiloxane which serves as a binder the amount of polysiloxane being sufficient to bind together the other components of the composition. The compositions are rendered floatable on the surface of water by incorporating into them a quantity of hollow microballoons in sufficient amount to lower the specific gravity of the composition concerned to less than 1.

4 Claims, No Drawings

FLOATABLE INCENDIARY COMPOSITION

Cross-References to Related Applications

This application is a Continuation-in-Part of Application Ser. No. 487,474, filed July 11, 1974, now abandoned and entitled "Incendiary Composition."

BACKGROUND OF THE INVENTION

The present invention relates to incendiary compositions and more particularly to incendiary compositions which are designed to float on the surface of water as a decoy for infrared seeking missles or for igniting combustible material at the water's surface.

The aforementioned parent application Ser. No. 487,474 of which this application is a Continuation-in-Part describes incendiary compositions for ignition of combustible materials which have both military use in the destruction of property and war materiel, and civilian application in the starting of backfires for forest fire control, for example. Those compositions described in the aforementioned application also have application as decoys for infrared seeking missiles.

Inasmuch as the compositions of the aforementioned application have a specific gravity greater than 1 the compositions while capable of burning will sink if they land in a body of water. There is, however, application for use of such incendiary compositions in devices floatable on the surface of a body of water for purposes such as igniting oil slicks floating on the water's surface, or providing signal flares on the water surface as well as for decoying infrared seeking missiles away from objects such as ships by burning such devices on the water's surface in the vicinity of the floating objects to be protected.

SUMMARY OF THE PRESENT INVENTION

It is accordingly an object of the present invention to provide a water surface capability to the types of incendiary compositions described in my copending Application Ser. No. 487,474, filed July 11, 1974, and to similar types of compositions which, although unsuitable for use in devices which utilize high explosives for dispersion, have use as flares or infrared decoys.

In accordance with this and other objects of the present invention it has been found that the specific gravities of the compositions disclosed in my aforedescribed application and similar types of compositions using different oxidizers all can be reduced to less than 1 to make them float by adding to the compositions prior to curing a quantity of hollow microballoons such as those made of glass, for example. Inasmuch as the silicone rubber-magnesium-oxidizer system described in the aforementioned application continues to burn even in contact with water the material thereby becomes useful as a water surface incendiary and by choice of proper oxidizers also has all of the advantages of the composition described in my prior application both in terms of handling and application.

As set forth in my prior application the composition of the present invention, in addition to the hollow microspheres consists essentially of magnesium powder, an oxidizer, and an elastomeric silicone. Depending upon the application and desired effect of the material the oxidizer need not necessarily be of the metallic salt or polytetrafluoroethylene types set forth in my aforementioned application, but may be also of the salt type such as potassium perchlorate. The silicone rubber binder (elastomeric polysiloxane) serves to isolate the magnesium particles from the oxidizer particles, and also serves to cushion the composition to allow rough handling without detonation or spontaneous ignition, or shattering upon being subjected to a detonation in proximity thereto. Further, the polysiloxane is believed to add oxygen to aid in burning and upon burning serves to bind the ash to provide a wicking action for ambient liquid combustibles such as floating oil, for example. The hollow microspheres serve merely to lighten the composition to cause it to rise to the water's surface and has been found to not materially detract from the other properties of the composition. The material can be molded, extruded, or rolled into sheets as desired in comparative safety.

DESCRIPTION OF PREFERRED EMBODIMENTS

The invention will become better understood to those skilled in the art by reading the following detailed description of preferred embodiments and the examples of specific compositions provided therein.

The composition of the present invention consists essentially of magnesium powder, oxidizer, elastomeric silicone and hollow microspheres dispersed in the composition to lower its specific gravity to less than 1.0 thereby causing it to be floatable on the surface of a body of water. In all cases the oxidizer, microspheres and magnesium powder are held together by an elastomeric polysiloxane binder which serves as a processing aid to avoid hazards in manufacture, allows molding, extruding, or rolling of any desired shape, serves to cushion and isolate the magnesium powder and oxidizer until burning is desired, and, it is believed, also serves to supply oxygen to enhance the burning of the composition.

The polysiloxanes utilized herewith are those having a polymer backbone of alternating silicon and oxygen atoms with pendent hydrocarbon groups on the silicon atoms. Such compositions are lightly crosslinked to form elastomeric materials and many such materials are commercially available as liquids curable to silicone rubbers. Some types are commonly known as room temperature vulcanizing silicone rubbers and others require application of heat to activate a vulcanizing agent to enhance curing. The pendent hydrocarbon groups on the silicon atoms in such materials are predominately methyl groups but some phenyl or vinyl groups are often included. The precise composition of such materials is not critical to the present invention since the material serves only as an isolation mechanism, cushion, and, it is believed, a partial oxygen supply for the magnesium and oxidizer.

The magnesium powder is preferably of the ground type rather than sperical powder because the ground material has more sharp edges and presents a greater surface area for ease in ignition. It is preferred that the magnesium powder be of 30 U.S. Standard screen mesh size or smaller. Mixed sizes can be used. In the case of a metal oxide type of oxidizer the group of oxides consisting of $Fe_3O_4$, $MnO_2$, and $TiO_2$ are satisfactory. The polytetrafluoroethylene should be in particulate form and for this purpose commercially available polytetrafluoroethylene molding powder has been found to be most satisfactory. If the material is not to be ignited by high explosive, for example, in the case where the material is to be used as an infrared decoy or flare, conventional salt type oxidizers such as sodium chlorate and potassium perchlorate can be used. These salt type oxidizers, however, are likely to cause detonation of the incendiary composition under the forces caused by detonation of high explosive and should therefore be avoided when the composition is to be dispersed by high explosives. Nitrates of potassium, sodium, barium, and strontium which are also known as oxidizers in flare compositions can be utilized.

In manufacture the magnesium is first wet with the curable polysiloxane liquid and then the oxidizing agent is added. At this point the microballoons are also added and if necessary a suitable, volatile solvent such as a naphtha, xylene or toluene is added in sufficient quantity to improve flowability sufficient to allow mixing. If heat curable polysiloxane is used the microspheres are preferably glass because some of the plastics are unable to withstand the heat of curing. If catalyst is needed for the curing of polysiloxane it is preferred that it be just prior to forming the material into its desired shape. However, it can be added to the polysiloxane liquid prior to adding the magnesium if so desired. After thorough mixing the composition is molded, extruded, or rolled into its desired configuration for placement in contact with the high explosive or alternatively, may be poured into a hollow in the high explosive. Alternatively, it can simply be fused for use as a flare or infrared decoy after placing in a canister. During the curing process any solvent previously added as a processing aid is released and forms no residue in the cured composition. It is to be noted that for safe compounding of the incendiary material, particularly in the case of the polytetrafluoroethylene or salt type oxidizers, the magnesium should be thoroughly wet by the liquid polysiloxane prior to addition of the oxidizer. Otherwise, there is danger of spontaneous ignition or detonation during compounding. The polysiloxane, however, serves to isolate the magnesium particles and although the composition is still match-sensitive the extreme hazard is eliminated by this precaution. There is no danger of detonation during molding or by handling after the material is cured.

It should be noted that the metallic oxides in the compositions using them are quite heavy relative to the weight of the polytetrafluoroethylene in the alternative compositions. Therefore, by mixing the first and second types of compositions a fairly wide range of specific gravities is possible. It is for this reason that no generally applicable minimum amount of the hollow microspheres can be set forth. Specific examples will be given in the specific examples set forth hereinafter but it is to be understood that the minimum amount necessary can be determined in any case by measurement. An excess of microspheres is not detrimental if the material remains bonded after molding.

In general, to cause flotation the necessary range of glass microspheres such as those commerically available from Emerson and Cuming under the designation 1G101 is between about 10 percent and 30 percent of the composition weight, but as indicated other quantities may at times be required. In any case simple experimentation will determine the necessary amount to cause the resultant material to float.

The materials as defined have sufficient strength and resilience to withstand either detonation, or pulverizing upon being subjected to nearby detonation as many prior art materials do. Although the materials may break up under forces of detonation, many of the pieces are large enough to sustain burning. Ignition takes place automatically by the detonation of the high explosive in which the materials are imbedded or placed in proximity to, or the material itself can be ignited by use of a fuze.

The following examples are illustrative of the invention.

EXAMPLE 1

Seventy pounds of spherical magnesium powder of 325 U.S. Standard screen mesh size were mixed into a dispersion of 20 lbs. of a commercially available room temperature vulcanizing organopolysiloxane sealant composition comprising a filled hydroxyl endblocked polydimethylsiloxane fluid and an alkyl orthosilicate which is dispersed in 50 lbs. of Naphtholite which is used as a solvent for decreasing viscosity of the mixture. To this mixture was then added 20 lbs. of glass microballoons (Emerson and Cuming 1G101) and then 10 lbs. of potassium perchlorate. The mixture was catalyzed with stannous octoate and poured into cylindrical molds to form canisters. Solvent was removed by a post cure of 24 hours at 160° F. Fuzes were inserted in the canisters and the material burned brightly while floating on water.

EXAMPLE 2

Canisters were made as set forth Example 1 using the same ingredients. In this case the proportions were 70 parts of the magnesium powder, 20 parts of the organopolysiloxane thinned in 30 parts solvent, 10 parts of the microballoons, and 5 parts of the potassium perchlorate, all parts being by weight. In this case the canisters floated but although several samples burned well, several other samples after ignition did not burn fully, indicating too low an oxidizer level for dependability.

Various modifications and variations of the invention as described herein will become obvious to those skilled in the art from a reading of the foregoing. It is to be understood, therefore, that within the scope of the appended claims the invention may be practiced otherwise than as specifically described.

That which is claimed is:

1. A floating incendiary composition comprising magnesium powder, an oxidizing agent for said magnesium, and a cured elastomeric polysiloxane binder, said composition further comprising a sufficient quantity of hollow microballoons to lower the specific gravity of the composition to less than 1.0, thereby rendering the composition floatable on the surface of water.

2. A floating incendiary composition as set forth in claim 1 wherein said hollow microballoons are glass.

3. A floating composition as set forth in claim 2 wherein said oxidizer is chosen from the group consisting of metallic oxides, particulate polytetrafluoroethylene, sodium chlorate, potassium perchlorate and nitrates of potassium, sodium, barium, and strontium.

4. In an incendiary composition the improvement which comprises incorporating therein sufficient hollow microballoons to render the specific gravity of the composition less than 1.0.

* * * * *